US007827655B2

(12) United States Patent
Yi

(10) Patent No.: US 7,827,655 B2
(45) Date of Patent: Nov. 9, 2010

(54) HINGE FOR FOLDING CONTAINER

(75) Inventor: Renbin Yi, Shenzhen (CN)

(73) Assignee: China International Marine Containers (Group) Ltd., Shenzhen (CN)

( * ) Notice: Subject to any disclaimer, the term of this patent is extended or adjusted under 35 U.S.C. 154(b) by 64 days.

(21) Appl. No.: 11/831,808

(22) Filed: Jul. 31, 2007

(65) Prior Publication Data

US 2008/0244864 A1 Oct. 9, 2008

(30) Foreign Application Priority Data

Aug. 1, 2006 (CN) ..... 2006 1 0061968

(51) Int. Cl.
*E05D 7/10* (2006.01)

(52) U.S. Cl. ..... 16/261; 16/254; 16/270; 16/387

(58) Field of Classification Search ..... 16/221, 16/254, 260, 261, 262, 263, 270, 271, 272, 16/349, 352, 353, 387; 220/1.5, 6, 666; 206/600; 108/55.1, 56.1
See application file for complete search history.

(56) References Cited

U.S. PATENT DOCUMENTS 4,300,695 A * 11/1981 Hsu ..... 220/6
5,644,992 A * 7/1997 Clive-Smith ..... 108/55.1
5,938,059 A * 8/1999 Luburic ..... 220/6
6,591,453 B2 * 7/2003 Jenks ..... 16/353
6,804,862 B2 * 10/2004 Miller ..... 16/386

FOREIGN PATENT DOCUMENTS

GB 2034283 A * 6/1980
GB 2073149 A * 10/1981
JP 02054214 A * 2/1990
JP 07257569 A * 10/1995

* cited by examiner

*Primary Examiner*—Victor Batson
*Assistant Examiner*—Jeffrey O'Brien
(74) *Attorney, Agent, or Firm*—Workman Nydegger

(57) ABSTRACT

A hinge for folding container comprises an inner hinge, an outer hinge and a locking device for locking the inner and outer hinge. Wherein, the inner hinge and the outer hinge are pivotally connected by a pivot pin, the outer hinge comprises at least two outer hinge plates provided in parallel, and the inner hinge comprises at least two inner hinge plates provided in parallel. Compared with the prior art, without changing the standard operating hole, the hinge for folding container disclosed by the present invention can widen the transverse width of the inner hinge, and so that the rigidity of the inner hinge is effectively enhanced. Therefore, the hinge according to the present invention can be applied to any types of folding container, especially the folding container mounted with an independent corner post.

17 Claims, 9 Drawing Sheets

HINGE FOR FOLDING CONTAINER

FIELD OF THE INVENTION

The present invention relates to components of a large-scale rigid folding container, and in particular, to components of a folding container including a hinge for the folding container.

BACKGROUND OF THE INVENTION

In the field of containers, folding containers are widely applied because of their small size after folding, the low transportation cost of the empty containers and their usefulness when loading and unloading cargo.

As early as the mid-1970's, folding containers have been designed, researched and applied. Temporal folding containers are reconstructed from dry freight containers, and, when loaded, the folding containers are used as a complete dry freight container; when unloaded, the roof panel is removed, the two side walls are folded inward respectively, on top of which the roof is laid, and then the two end walls are folded inward. Such temporal folding containers save unloading transportation costs, but due to complicated operation, such containers were not popular until the later 1970's when the hinge for folding containers was successfully launched.

As shown in FIGS. 1 and 2, a hinge 1 for a commonly used folding container comprises an outer hinge 10 composed of two parallel plates and an inner hinge 11 provided within the outer hinge and connected with the outer hinge 10 through a pivot pin 13. A hinge top plate 12 is provided on top of the outer hinge 10, and a taper pin 14 for locking the inner hinge 11 and the outer hinge 10. A hinge top plate 12 is provided with an aperture 120 for housing the inner hinge 11, when not housing the inner hinge 11, the aperture 120 is used to place an ISO twist lock, whose width is around 60 mm, for container to containers interlocking. Taper holes 101 and 111 are provided on the outer hinge 10 and inner hinge 11, respectively, and when needed, the taper pin 14 is placed through the taper holes 101 and 111, to lock the inner hinge 11 and outer hinge 10. In order to simplify the use of the folding container, a bottom corner fitting 23 is generally welded at the bottom of the outer hinge.

As shown in FIG. 3, when hinge 1 is installed in the folding container, the outer hinge 10 is welded to bottom side rails 201 that are on two sides of base 20 of the container 2. The top of the inner hinge 11 is welded to the bottom of the corner post 210 that is on two sides of an end wall 21. When the end wall 21 is raised, the taper pin 14 locks the inner and outer hinge, so that the gap between the inner and outer hinge is quite small, which perfectly ensures the stability of the erected end wall.

The end wall functions to pile, lift and form load space together with the base and prevent cargos from longitudinal sliding. A common end wall, as shown in FIG. 4, comprises corner posts 210 placed at the two sides thereof, a top corner section 211 welded on top of the corner posts 210, a header 212 welded breadthwise on top of the two corner posts 210, a sill 213 welded breadthwise at the bottom of the two corner posts 210, and an end wall panel 214, whose four sides are welded with the corner posts 210, the header 212, and the sill 213, respectively. During the transportation of the container, the end wall suffers from transverse thrust. As shown in FIG. 4, the structure of the end wall 21 is complete and the components are connected each other by a weld. Therefore, when the top of the end wall 21 suffers from transverse thrust F, the transverse rigidity of the hinge 1 can satisfy the usage requirement. However, the structure of the end wall, as shown in FIG. 5, has only corner posts 210 located at two sides thereof (such corner posts, which bears the transverse thrust alone, are called independent corner posts). If the top of the corner post 210 suffers force F, then the transverse rigidity of the hinge 1 can hardly satisfy the usage requirement. Because the width of the aperture 120 on the hinge top plate 12 is around 63 mm, it is almost impossible to enhance the inner hinge along the width direction to satisfy the usage requirement.

SUMMARY OF THE INVENTION

Against the deficiency of the prior art, the object of the present invention is to provide a hinge for a folding container that satisfies folding corner posts of the folding container and enhances the transverse rigidity thereof.

In order to realize the above objective, the present invention applies the following technical solution:

A hinge for the folding container comprises an inner hinge, an outer hinge and a locking device for locking the inner and the outer hinge; wherein, the inner hinge and the outer hinge are pivotally connected by a pivot pin, the outer hinge comprises at least two outer hinge plates provided in parallel, and the inner hinge comprises at least two inner hinge plates provided in parallel.

The hinge for the folding container as mentioned above, wherein, a hinge top plate is provided on the top of the outer hinge, and two slots for housing the two inner hinge plates are provided in parallel on the hinge top plate along the breadth direction of the inside and outside of the container.

The hinge for the folding container as mentioned above, wherein, the hinge top plate is in the shape of an upside-down "L".

The hinge for the folding container as mentioned above, wherein, the width of the slots inside the container matches the width of an ISO standard twist lock for containers; or the width of the slots outside the container matches the width of an ISO standard twist lock for containers; or the width of the slots inside and outside the container all match the width of an ISO standard twist lock for containers.

The hinge for the folding container as mentioned above, wherein, the top or bottom of the two inner hinge plates are connected by a boss or a connection plate as a whole, and so that an integral structure of the two inner hinge plates is formed.

The hinge for the folding container as mentioned above, wherein, the top and bottom of the two inner hinge plates are all connected by a boss or a connection plate as a whole, and so that an integral structure of the two inner hinge plates is formed.

The hinge for the folding container as mentioned above, wherein, a reinforcement plate is provided between the two outer hinge plates, the top of the reinforcement plate is fixed with the bottom surface of the outer hinge top plate and located between the two slots.

The hinge for the folding container as mentioned above, wherein, the locking device is a taper pin, and corresponding taper holes are opened on the inner hinge plates and the outer hinge plates; when the inner hinge plates are erected against the outer hinge, the taper pin is inserted into the taper holes to lock.

The hinge for the folding container as mentioned above, wherein, the locking device is a square pin, and corresponding square slots are opened at the rear end of the inner hinge plates and the outer hinge plates; when the inner hinge plates are erected against the outer hinge, the square pin is inserted into the square slots to lock.

Compared with the prior art, without changing the standard operating hole, the hinge for a folding container disclosed by the present invention can widen the transverse width of the inner hinge, so that the rigidity of the inner hinge is effectively enhanced. Therefore, the hinge according to the present invention can be applied to any types of folding container, especially folding containers mounted with independent corner posts.

DETAILED DESCRIPTION OF THE DRAWINGS

In order to further illustrate the technical means and effect of the present invention for realizing the predefined objective, the present invention is detailed combining with the following figures. The object, features and specifications of the present invention can be understood deeply and particularly hereafter. However, the figures are just for reference and illustration, not to limit the present invention.

The present invention is further detailed in the following figures and embodiments.

DETAILED DESCRIPTION OF THE INVENTION

Embodiment 1

Figure 6:
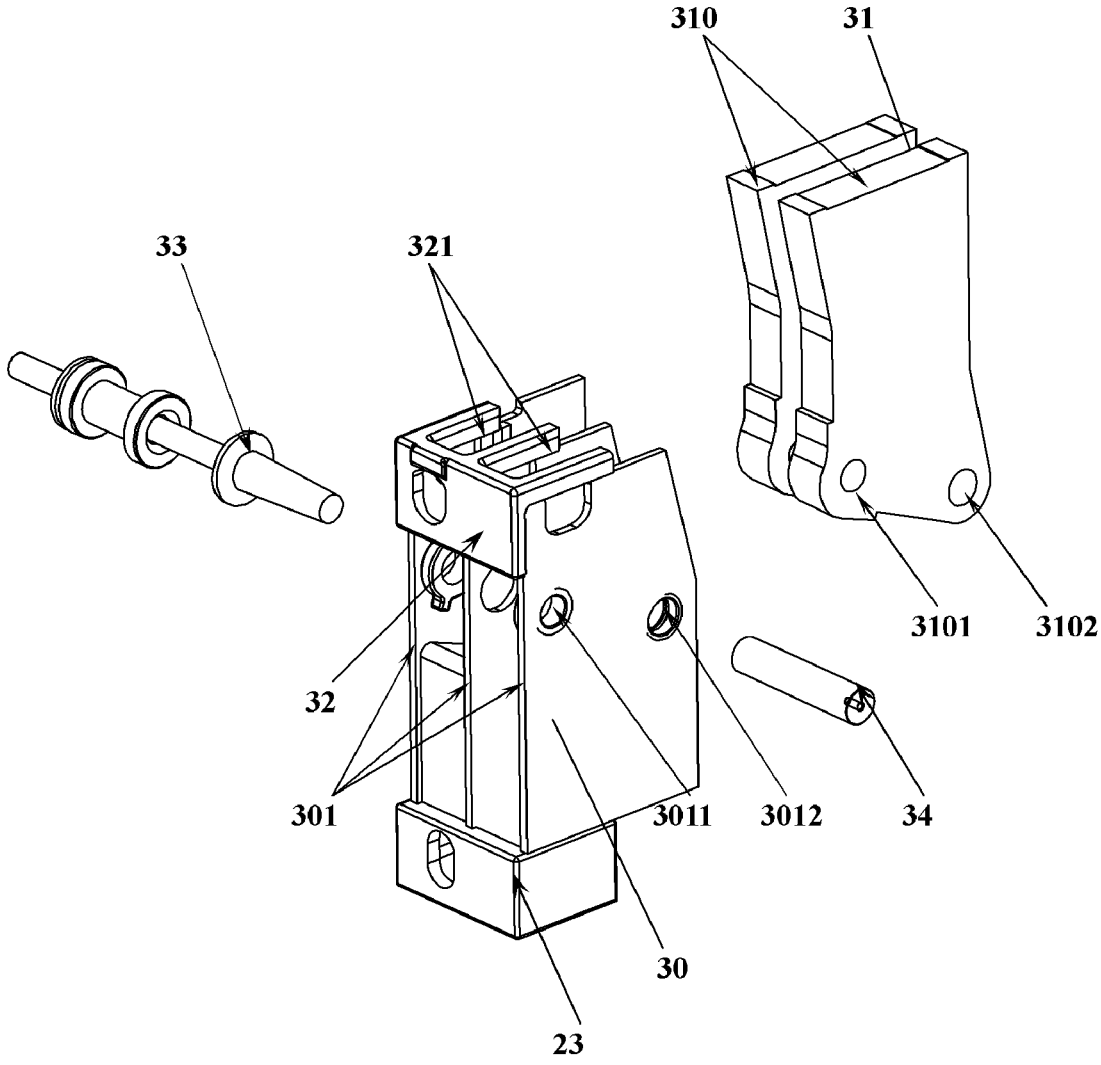
FIG. 6 shows the structure sketch of a hinge according to a first embodiment of the present invention.

As shown in FIG. 6, a hinge for a folding container according to the present invention comprises an inner hinge 31 constituted by two inner hinge plates 310 provided in parallel with a certain distance between them and an outer hinge 30 constituted by two outer hinge plates 301 provided in parallel with a certain distance between them. Meanwhile, a reinforcement plate is provided between the two outer hinge plates to enhance. In the present embodiment, because the shape of the reinforcement plate is the same as the outer hinge plate 301, the reinforcement plate is normally called the outer hinge plate. A hinge top plate 32 is fixed on the top of the outer hinge 30, which is preferably in a shape of upside-down "L". Two slots 321 for housing the two inner hinge plates 310 are provided in parallel on the hinge top plate 32 along the breadth direction of the container. When installing the hinge, the two inner hinge plates 310 are located between the three outer hinge boards 301 (including the two outer hinge plates and the reinforcement plate therebetween). A pin 34 is inserted into holes 3102 and 3012 on the inner hinge plate 310 and the outer hinge plate 301, respectively, so that the inner hinge 31 and the outer hinge 30 are connected pivotally the inner hinge 31 is pivotal against the outer hinge 30, with the pin 34 as the axis. When the inner hinge 31 is erected against the outer hinge 30, the two inner hinge plates 310 can be located in the two slots 321 opening on the hinge top plate 32, respectively. Then, a cylindrical pin 33 may be inserted into taper holes 3101 and 3011 opening on the inner hinge plate 310 and the outer hinge plate 301, respectively, so the lock between the inner hinge 31 and the outer hinge 30 is realized.

The thickness of one inner hinge plate, according to the present embodiment, is 60 mm. The corresponding distance between the two outer hinge plates located aside thereof should be wider than 60 mm, in order to ensure that the inner hinge plate can pivot between the outer hinge plates and that the inner hinge plate can be inserted into the hole on the hinge top plate at the same time, wherein the width of the hole matches the housing requirement of an ISO standard twist lock for containers. However, the thickness of an additional inner hinge plate is variable. The distance between the two outer hinge plates located aside thereof may match the thickness and the width of the holes on the hinge top plate for housing the two inner hinge plates may also match the thickness. Furthermore, the two inner hinges can be connected by a boss or a connection plate, so that the inner hinge is formed as a whole.

Figure 3:
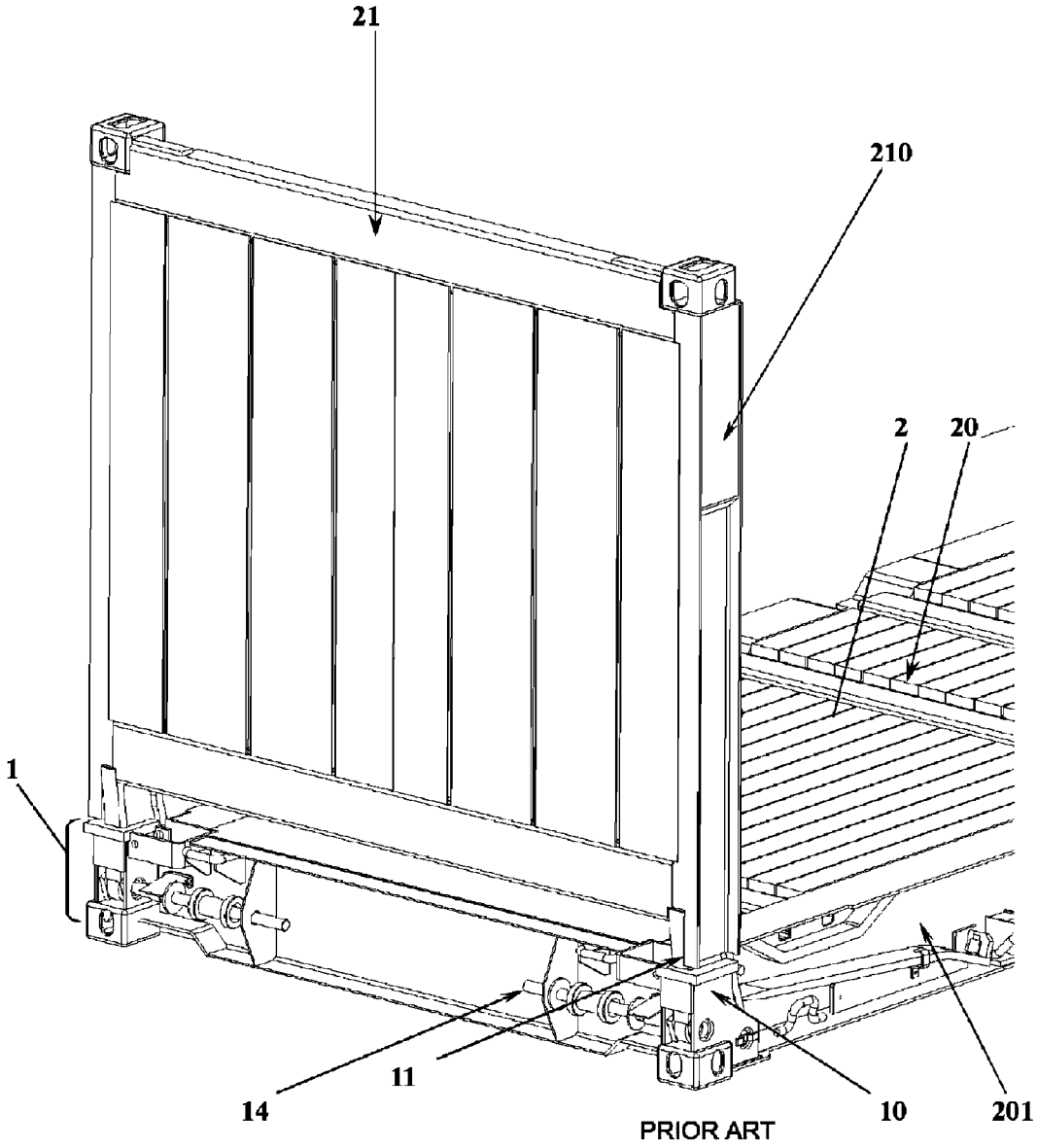
FIG. 3 shows the structure sketch of a folding container according to the prior art.
Figure 4:
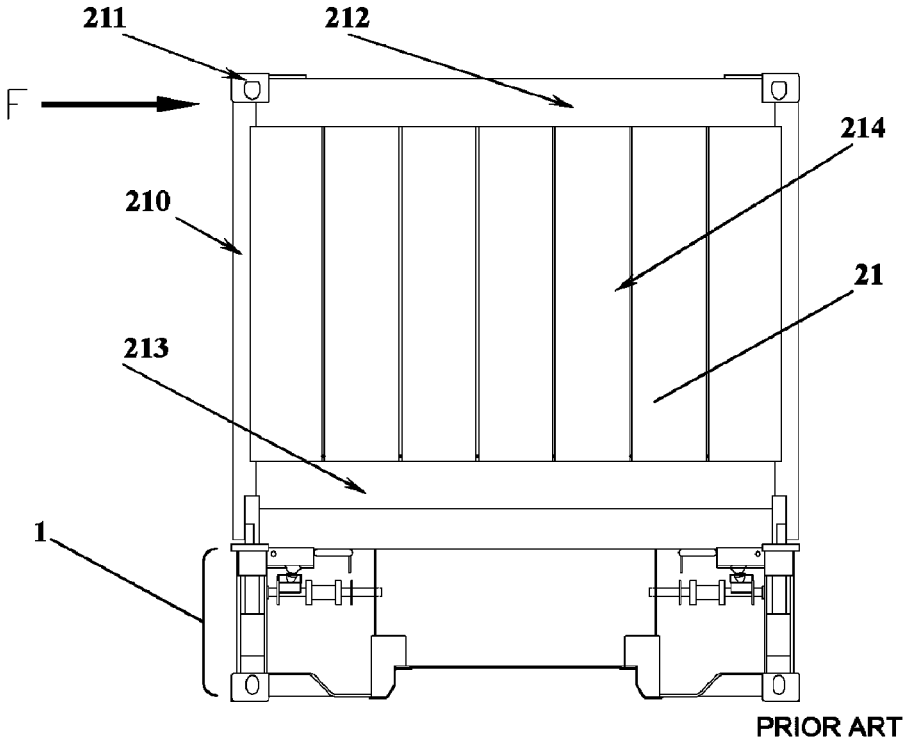
FIG. 4 shows one structure sketch of the end of a folding container according to the prior art.
Figure 5:
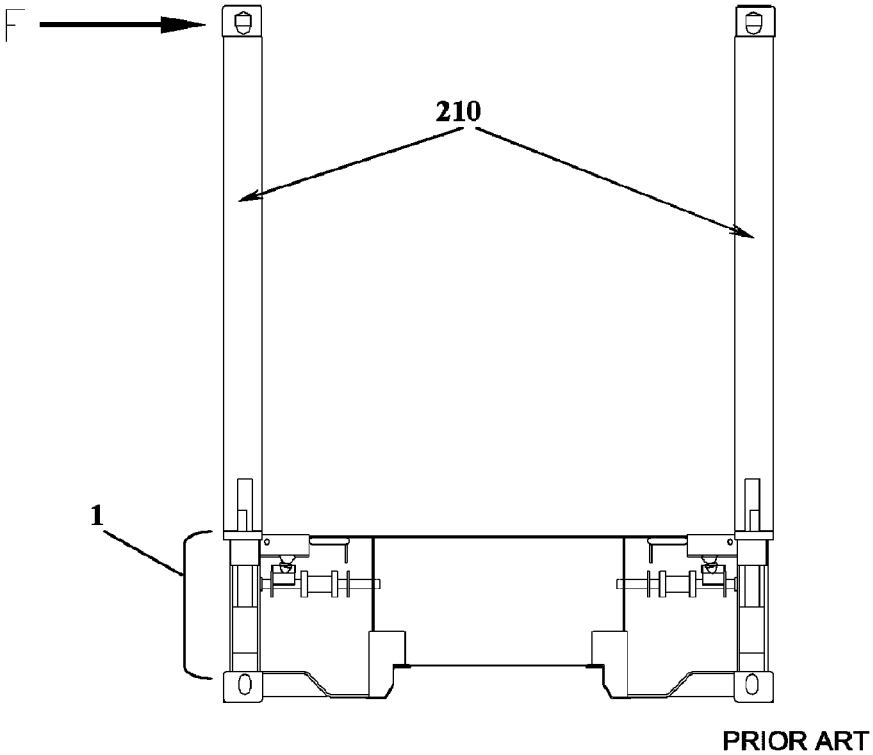
FIG. 5 shows another structure sketch of the end of a folding container according to the prior art.

When the hinge according to the present embodiment is installed in a folding container, the outer hinge is welded to the bottom side rails along two sides of the base of the folding container, and the top of the two inner hinge plates is welded to the bottom of a corner post along two sides of the end wall. There are two modes for welding the two inner hinge plates to the bottom of the corner post: (1) after connecting them to each other, the top of the two inner hinge plates are welded to the bottom of the corner post; or (2) the two inner hinge plates are welded to the bottom of the corner post (reference to FIG. 3). Meanwhile, as shown in FIG. 6, in order to improve the operation and protection of the folding container, a bottom corner fitting 23 is welded to the bottom of the outer hinge 30. All three outer hinge plates 301 can be welded to the bottom corner fitting 23, or only two outer hinge plates 301 aside the outer hinge can be welded to the bottom corner fitting 23.

Figure 1:
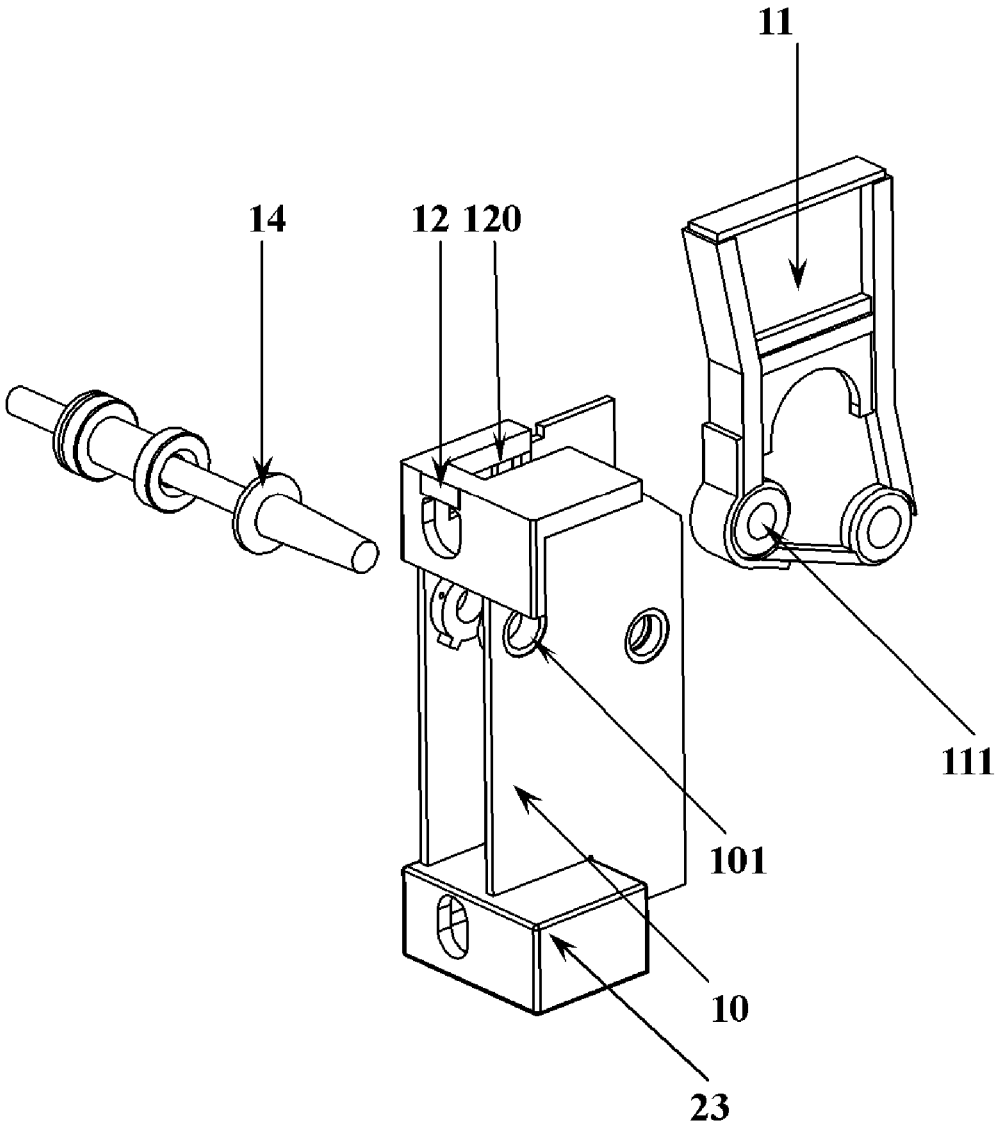
PRIOR ART Figure 1
FIG. 1 shows the decomposing sketch of a general hinge according to the prior art.
Figure 2:
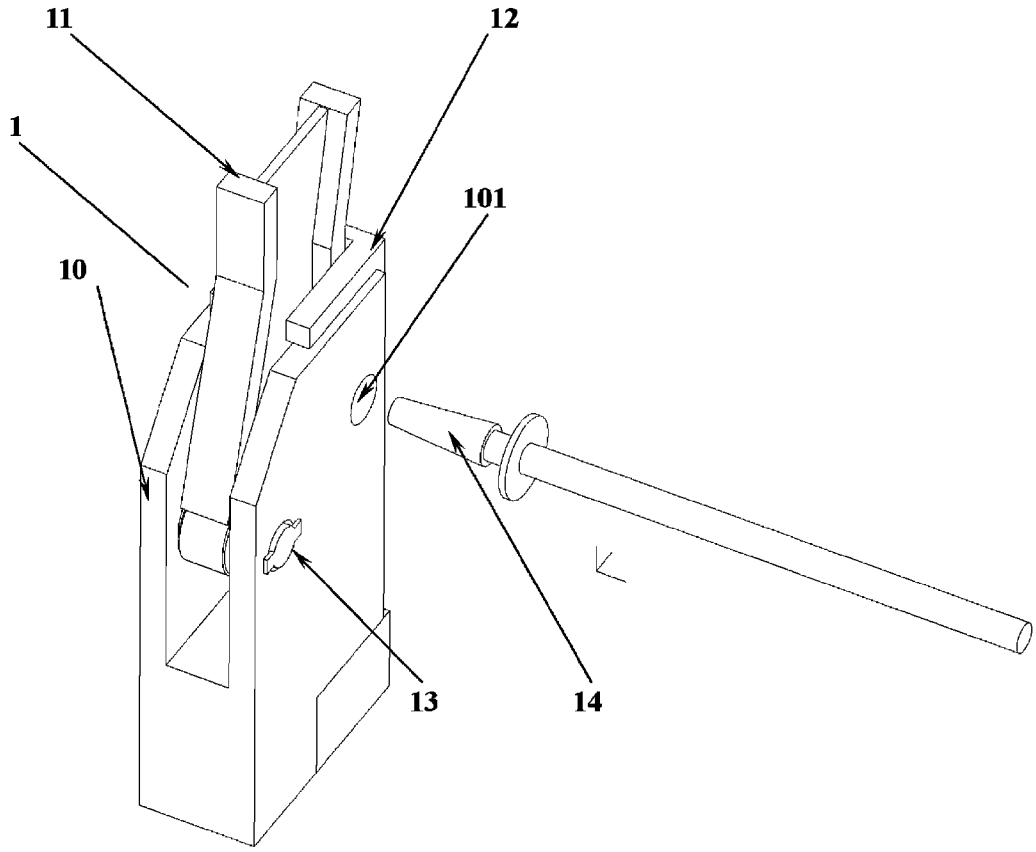
PRIOR ART Figure 2
FIG. 2 shows the structure sketch of a general assembled hinge according to the prior art.
Figure 7:
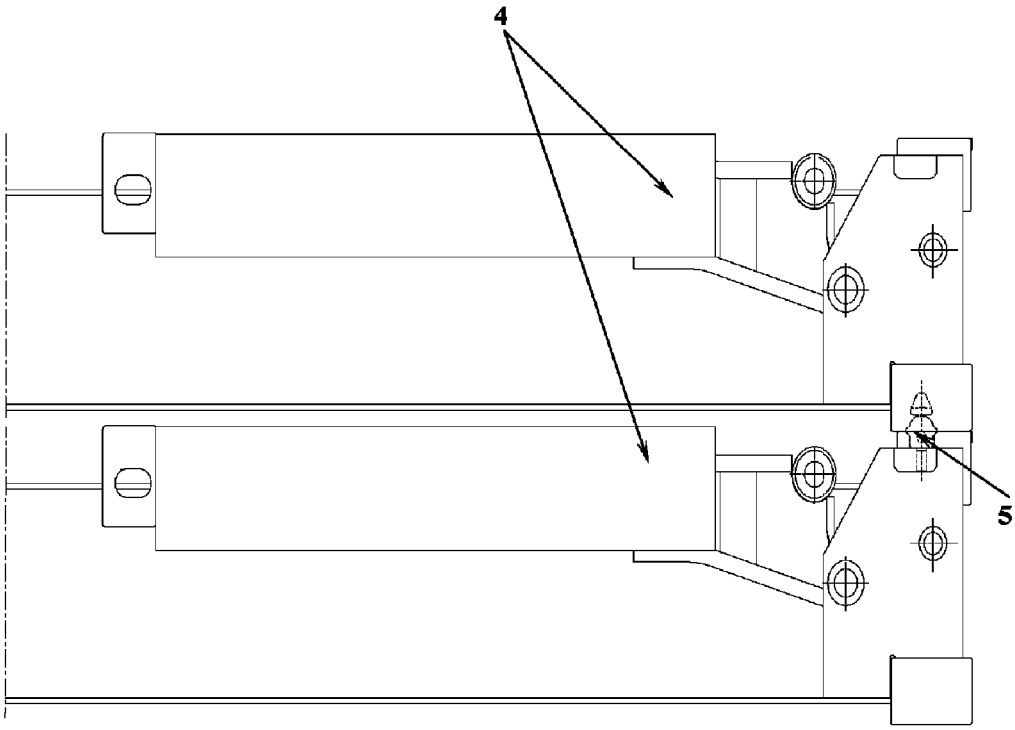
PRIOR ART Figure 7
FIG. 7 shows the sketch of stacked folding containers according to the prior art.

As shown in FIG. 7, when piling empty normal folding containers 4, in order to ensure the safety of the stack, the neighbor upper and lower containers are interlocked by an ISO standard twist lock 5 for containers, which is located in the housing slot 120 of the hinge top plate 12 (as shown in FIG. 1), and whose top can be stuck in the bottom hole (not shown in figure) of the bottom corner fitting 23. In other words, in order to ensure the reliability of the interlock, the width of the housing hole 120 must satisfy the requirements of installing the ISO standard twist lock for containers.

The hinge according to the present embodiment has two housing slots 321, and the width of at least one of the two housing slots satisfies the requirements of installing the ISO standard twist lock for containers.

Embodiment 2

Figure 8:
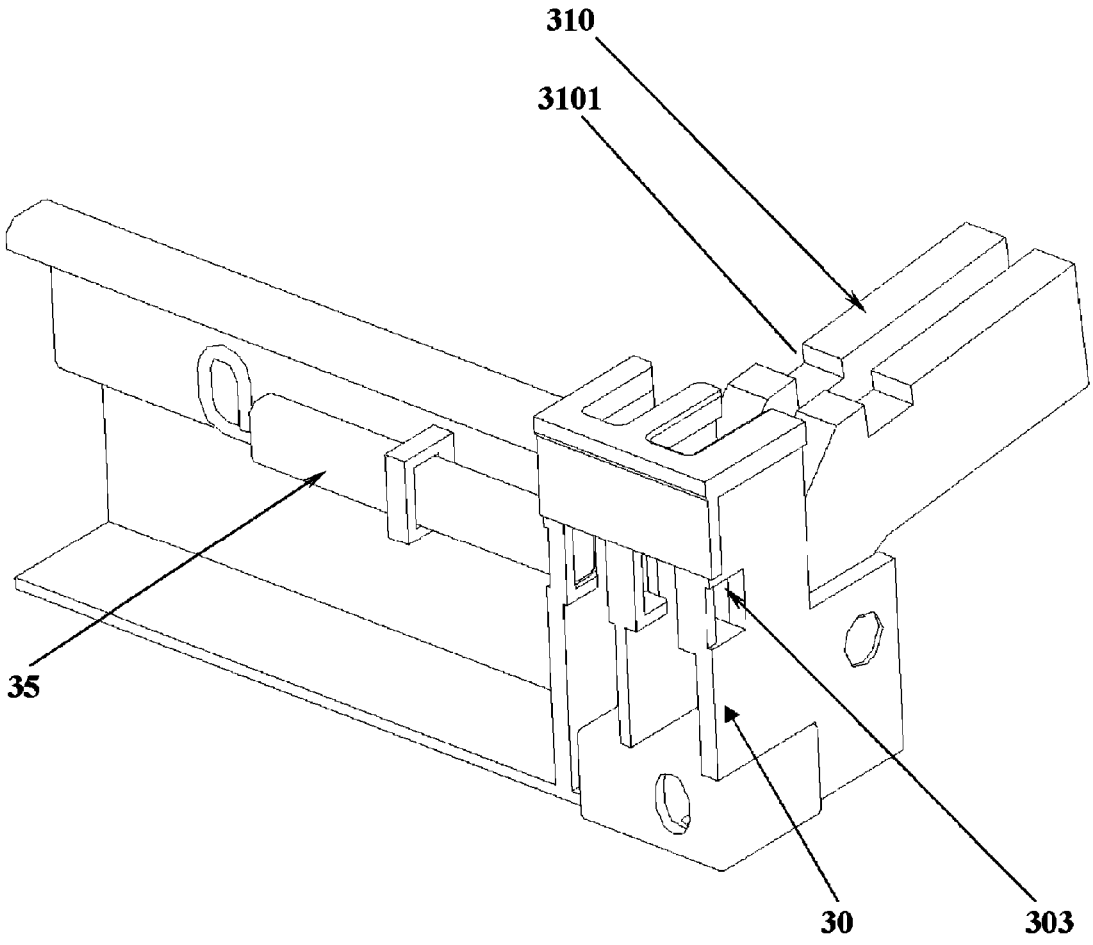
FIG. 8 shows the structure sketch of a hinge according to a second embodiment of the present invention.

FIG. 8 shows a hinge according to a second embodiment of the present invention. The structure of the hinge is similar to that of the embodiment 1, while modifications are made to the structures of the inner hinge plate and the locking device. In particular, three square slots 3101 are opened at the rear end of each of the corresponding three inner hinge plates 310, and three square apertures 303 are opened at the rear end of the three outer hinge plates 30; when the inner hinge plates 310 are erected against the outer hinge, a square pin 35 can be inserted into the square slots 3101 and the square apertures 303 to lock the inner hinge and the outer hinge.

Embodiment 3

Figure 9:
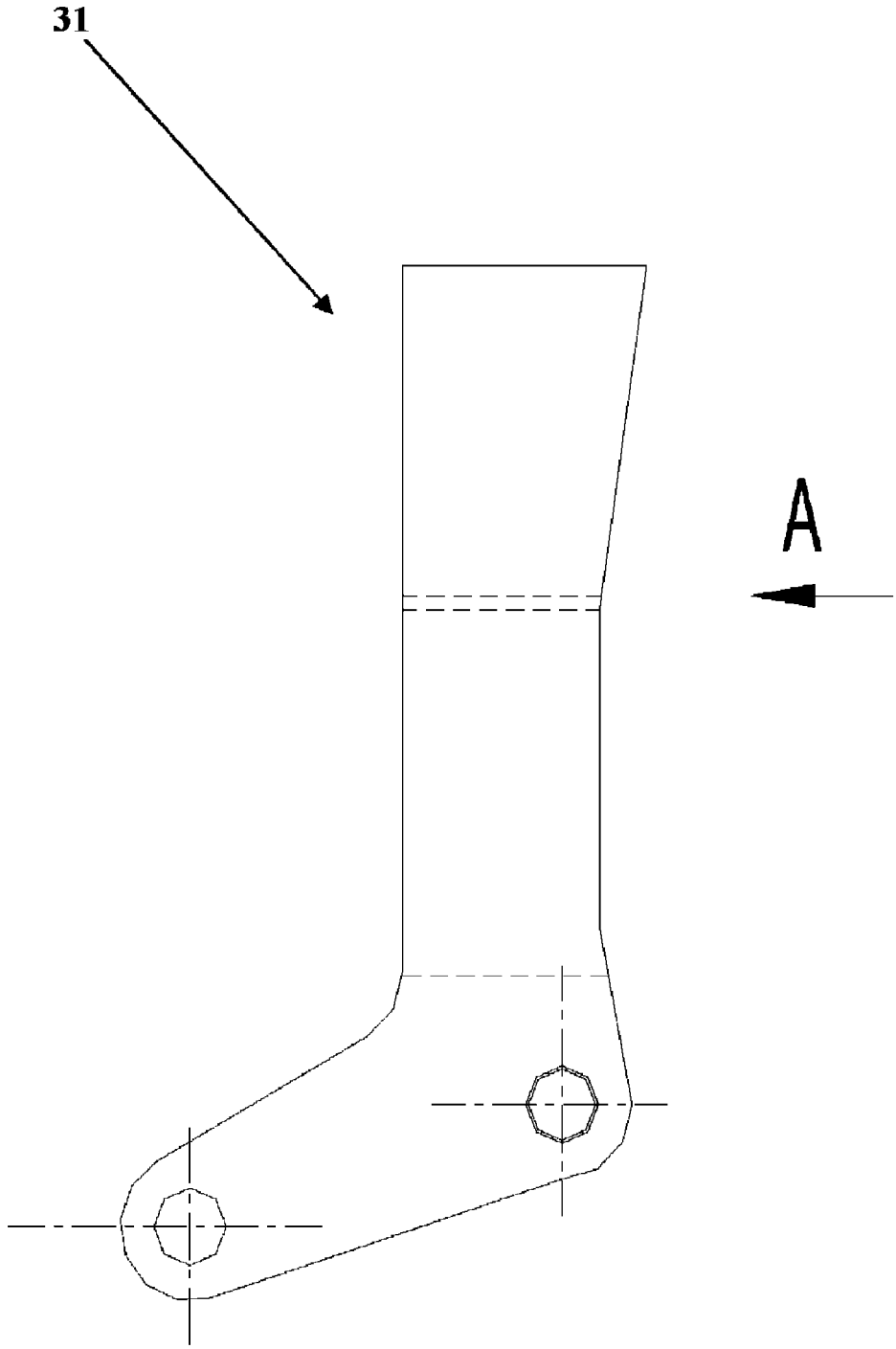
FIG. 9 shows the front view of the inner hinge plate for a hinge according to a third embodiment of the present invention.
Figure 10:
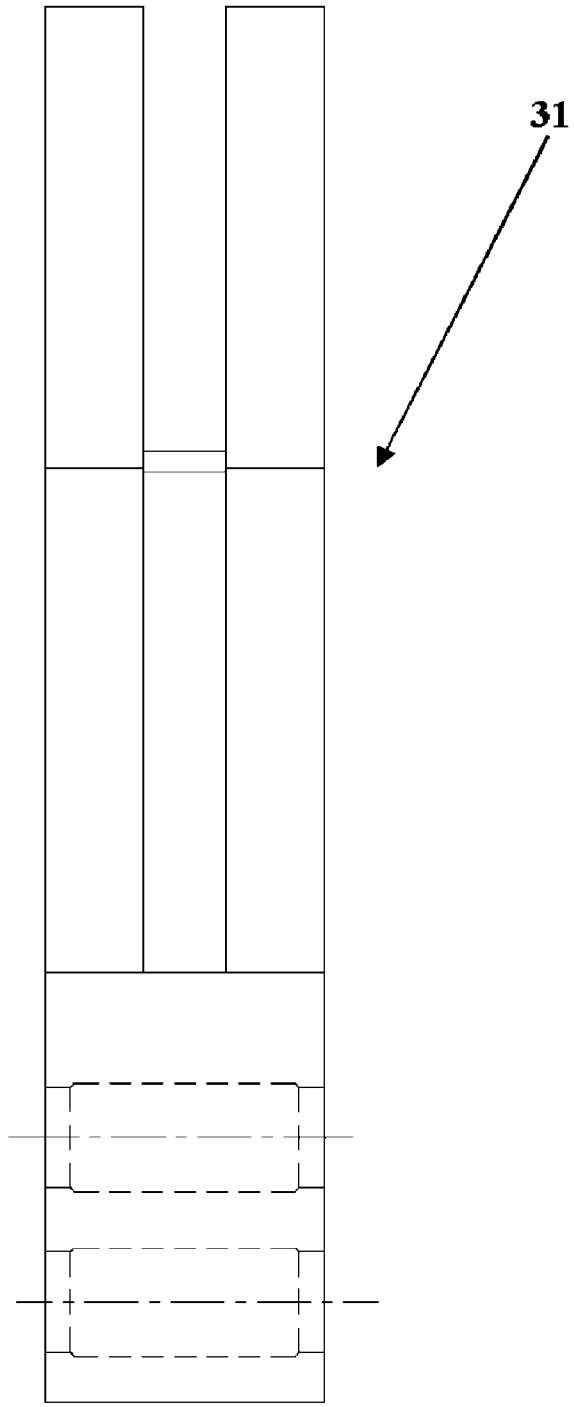
FIG. 10 shows the view from A in FIG. 9.

FIGS. 9 and 10 show a hinge according to a third embodiment of the present invention. The structure of the hinge is similar to that of the embodiment 1, while a modification is made to the structure of the inner hinge 31. In particular, the bottoms of the two inner hinge plates are connected as a whole, so that an integral structure of the inner hinge is formed. For the structure of the inner hinge where the bottom of the two inner hinge plates are connected as a whole, the corresponding outer hinge is composed of two parallel outer hinge plates having a certain distance between them. In order to house the two inner hinge plates, whose bottom is connected as a whole and tops are separated, two housing slots are opened on a hinge top plate along the breadth direction of the container, wherein the hinge top plate is on the top of the outer hinge. In order to achieve an enhancement according to the connection mode of the two inner hinges, an enhance board matching the two parallel outer hinge plates can be provided therebetween.

The above modification for the structure of the inner hinge may be embodied as the top of the two inner hinge plates are connected as a whole, so that an integral structure of the inner hinge is also formed. While for the structure of the inner hinge where the top of the two inner hinge plates are connected as a whole, the corresponding outer hinge is composed of two outer hinge plates in parallel with a certain distance between them. For housing the two inner hinge plates whose top are connected as a whole and bottom are separated, two housing slots are opened on a hinge top plate along the breadth direction of the container for housing the two inner hinge plates, wherein the hinge top plate is on the top of the outer hinge. In order to achieve such an enhancement according to the connection mode of the two inner hinges, a reinforcement plate matching the two parallel outer hinge plates can be provided therebetween.

Additionally, the above modification for the structure of the inner hinge may be embodied as the top and the bottom of the two inner hinge plates are all connected as a whole, so that an integral structure of the inner hinge is also formed. The corresponding outer hinge, the top plate thereof and the setting of the reinforcement plate will not be detailed herein any more.

According to common knowledge, the present invention can be realized by other embodiments that fall within the spirit and scope of the principles of the disclosure. Therefore, the above illustrations should not limit the implementations of the present invention. Numerous other modifications and embodiments can be devised in the art that fall within the spirit and scope of the claims, all of which are included by the present invention.

The invention claimed is:

1. A hinge for a folding container, the hinge comprising:

an inner hinge comprising at least first and second inner hinge plates provided in parallel, each of the first and second inner hinge plates having a substantially uniform thickness;

an outer hinge comprising:

first and second outer hinge plates provided in parallel;

a reinforcement plate provided in parallel between the first and second outer hinge plates, wherein the first outer hinge plate and reinforcement plate define a first space therebetween for accommodating at least a portion of the first inner hinge plate and wherein the second outer hinge plate and reinforcement plate define a second space therebetween for accommodating at least a portion of the second inner hinge plate; and a reinforcing structure sandwiched between the first outer hinge plate and the reinforcement plate in a portion of the first space, a remaining portion of the first space being sufficient to accommodate the at least a portion of the first inner hinge plate;

wherein the inner and outer hinge are pivotally connected by a pivot pin;

a locking device for locking the inner and the outer hinge; and a hinge top plate connected on a top of the outer hinge, the hinge top plate having at least two slots for housing the at least first and second inner hinge plates, the at least two slots opening in parallel on the hinge top plate.

2. The hinge for a folding container according to claim 1, wherein the at least two slots for housing the first and second inner hinge plates are opened in parallel on the hinge top plate along the breadth direction of the container inside and outside.

3. The hinge for a folding container according to claim 2, wherein, the hinge top plate is in a shape of an upside-down "L".

4. The hinge for a folding container according to claim 2, wherein, the width of the slots inside the container matches the width of an ISO standard twist lock for container.

5. The hinge for a folding container according to claim 3, wherein, the width of the slots inside the container matches the width of an ISO standard twist lock for container.

6. The hinge for a folding container according to claim 2, wherein, the width of the slots outside the container matches the width of an ISO standard twist lock for container.

7. The hinge for a folding container according to claim 3, wherein, the width of the slots outside the container matches the width of an ISO standard twist lock for container.

8. The hinge for a folding container according to claim 2, wherein the top of the reinforcement plate is fixed with the bottom surface of the hinge top plate and located between the at least two slots.

9. The hinge for a folding container according to claim 3, wherein the top of the reinforcement plate is fixed with the bottom surface of the hinge top plate and located between the at least two slots.

10. The hinge a for folding container according to claim 2, wherein, the top and/or the bottom of the first and second inner hinge plates are connected as a whole to form an integral structure of the inner hinge.

11. The hinge for a folding container according to claim 3, wherein, the top and/or the bottom of the first and second inner hinge plates are connected as a whole to form an integral structure of the inner hinge.

12. The hinge for a folding container according to claim 10, wherein, the first and second inner hinge plates are connected by a boss or a connection plate.

13. The hinge for folding container according to claim 11, wherein, the first and second inner hinge plates are connected by a boss or a connection plate.

14. The hinge for a folding container according to claim 1, wherein, the locking device is a taper pin, and corresponding taper holes are opened on the inner hinge plates and the outer hinge plates; when the inner hinge plates erect against the outer hinge, the taper pin is inserted into the taper holes to lock.

15. The hinge for a folding container according to claim 2, wherein, the locking device is a taper pin, and corresponding taper holes are opened on the inner hinge plates and the outer hinge plates; when the inner hinge plates erect against the outer hinge, the taper pin is inserted into the taper holes to lock.

16. The hinge for a folding container according to claim 3, wherein, the locking device is a taper pin, and corresponding taper holes are opened on the inner hinge plates and the outer hinge plates; when the inner hinge plates erect against the outer hinge, the taper pin is inserted into the taper holes to lock.

17. The hinge for a folding container according to claim 1, wherein the at least two slots have different widths.

* * * * *